US006684662B2

(12) United States Patent
Manaka et al.

(10) Patent No.: US 6,684,662 B2
(45) Date of Patent: Feb. 3, 2004

(54) REFRIGERATION SYSTEM, AND CONDENSER FOR USE IN DECOMPRESSING-TUBE SYSTEM

(75) Inventors: Hideaki Manaka, Oyamashi (JP); Hirohiko Watanabe, Oyamashi (JP); Ryoichi Hoshino, Oyamashi (JP); Yasuhiro Takahashi, Oyamashi (JP)

(73) Assignee: Showa Denko K.K., Minato-ku (JP)

( * ) Notice: Subject to any disclaimer, the term of this patent is extended or adjusted under 35 U.S.C. 154(b) by 0 days.

(21) Appl. No.: 10/057,062

(22) Filed: Jan. 25, 2002

(65) Prior Publication Data

US 2002/0148248 A1 Oct. 17, 2002

Related U.S. Application Data

(63) Continuation-in-part of application No. 09/883,529, filed on Jun. 18, 2001, now Pat. No. 6,370,909, which is a continuation of application No. 09/544,098, filed on Apr. 6, 2000, now Pat. No. 6,250,103, and a continuation of application No. 09/610,031, filed on Jul. 5, 2000.

(60) Provisional application No. 60/142,654, filed on Jul. 6, 1999.

(30) Foreign Application Priority Data

Sep. 14, 2001 (JP) ..... 2001-278975

(51) Int. Cl.[7] ..... F25B 41/06; F25B 43/00

(52) U.S. Cl. ..... 62/503; 62/511

(58) Field of Search ..... 62/509, 511, 527

(56) References Cited

U.S. PATENT DOCUMENTS

| | | | | |
|---|---|---|---|---|
| 6,250,103 | B1 | * | 6/2001 | Watanabe et al. |
| 2001/0035025 | A1 | * | 11/2001 | Watanabe et al. |

FOREIGN PATENT DOCUMENTS

| | | | | |
|---|---|---|---|---|
| CH | 20001281 | A | * | 4/2000 |
| EP | 1043552 | A1 | * | 10/2000 |
| JP | 02-254269 | | | 10/1990 |
| JP | 05-010633 | | | 1/1993 |
| JP | 06-050615 | | | 2/1994 |
| JP | 2000-356436 | A | * | 12/2000 |
| JP | 2001-227844 | A | * | 8/2001 |
| JP | 2001-235255 | A | * | 8/2001 |

* cited by examiner

*Primary Examiner*—Melvin Jones

(57) ABSTRACT

This refrigeration system is an orifice-tube system constituting a refrigeration cycle in which a refrigerant passes through a compressor 1, a condenser 10, an orifice-tube 3, an evaporator 4, and an accumulator 5 in this order and then returns to the compressor 1. The condenser 10 is constituted by the so-called multi-flow type heat exchanger having a plurality of passes P1–P3. The intermediate pass P2 is constituted as a decompression pass for decompressing the refrigerant. After condensing the refrigerant by the first pass P1, the condensed refrigerant is decompressed and evaporated by the decompression pass P2, and then the evaporated refrigerant is re-condensed by the third pass P3. This refrigeration system is excellent in response characteristic to thermal load fluctuations and in refrigeration performance.

18 Claims, 11 Drawing Sheets

REFRIGERATION SYSTEM, AND CONDENSER FOR USE IN DECOMPRESSING-TUBE SYSTEM

CROSS REFERENCE TO RELATED APPLICATIONS

This is a continuation-in-part of commonly assigned U.S. patent application Ser. No. 09/883,529 filed on Jun. 18, 2001, now U.S. Pat. No. 6,370,909 which is a continuation application of U.S. patent application Ser. No. 09/544,098 filed on Apr. 6, 2000, now matured as U.S. Pat. No. 6,250,103. This is also a continuation of commonly assigned U.S. patent application Ser. No. 09/610,031 filed on Jul. 5, 2000 claiming the benefit of a provisional application Ser. No. 60/142,654 filed on Jul. 6, 1999.

BACKGROUND OF THE INVENTION

1. Field of the Invention

The present invention relates to a refrigeration system for air-conditioners including a refrigeration cycle which employs a decompressing tube as decompressing means such as an orifice-tube or a capillary tube, and also relates to a condenser for use in a decompressing-tube system.

2. Description of Related Art

Generally, as a refrigeration system to be adopted for car air-conditioners or the like, the following refrigeration systems are well known: (1) an expansion-valve type refrigeration system including an automatic thermal expansion valve (TXV) as a decompressing means (hereinafter referred to as "expansion valve system"); and (2) an orifice-tube type refrigeration system (CCOT) including a decompressing tube as decompressing means such as an orifice-tube or a capillary tube (hereinafter referred to as "orifice-tube system" or "decompressing-tube system").

As shown in FIG. 13, in the orifice-tube system, the gaseous refrigerant of high temperature and high pressure from the compressor 1 flows into the condenser 2 to be condensed therein. Then, the condensed refrigerant passes through the orifice-tube 3 to be decompressed and then flows into the evaporator 4. In the evaporator 4, the condensed refrigerant exchanges heat with the ambient air to be evaporated, and then is introduced into the accumulator 5. In the accumulator 5, only the gaseous refrigerant is separated from the refrigerant introduced in the accumulator 5, and the gaseous refrigerant returns to the aforementioned compressor 1. Thus, a refrigeration cycle is formed.

As compared with the expansion valve system, this orifice-tube system has fewer components and can be fabricated by fewer steps. Furthermore, the orifice-tube system is simple in structure and low in manufacturing cost.

The orifice-tube system is, however, inferior in response to load fluctuations.

That is, in the orifice-tube system, a liquefied refrigerant R stagnates at the subcooling area ranging from near the inlet of the orifice-tube 3 to the outlet of the condenser 2. This liquefied refrigerant R increases when the thermal load of the condenser 2 is small. For example, when an automobile mounting this refrigeration system is running at a high speed, the thermal load of the condenser 2 is small because of an enough amount of ventilation. In this case, the condenser performance can be fully demonstrated, resulting in an enhanced condensation of the refrigerant therein.

By the way, the amount of refrigerant passing through the orifice-tube 3 (i.e., circulation amount of refrigerant) is constant, and the amount of refrigerant passing through the orifice-tube 3 is limited. Accordingly, in cases where the thermal load of the condenser decreases suddenly, for example, when the running speed of the car is changed from a low-speed to a high-speed, the amount of liquefied refrigerant increases suddenly, and the subcooling area spreads even in the condenser 2. As a result, a large amount of liquefied refrigerant is temporarily accumulated in the condenser 2. When a large amount of liquefied refrigerant is accumulated in the condenser 2, the condensation of refrigerant will not be performed in the liquefied refrigerant stagnated portion. Accordingly, the effective area for condensing the refrigerant decreases, which in turn decreases the condenser performance.

To the contrary, in cases where the thermal load of the condenser increases suddenly, for example, when the running speed of the car is changed from a high-speed to a low-speed, the refrigerant is not condensed smoothly in the condenser 2. As a result, the amount of liquefied refrigerant accumulated in the outlet side portion in the condenser 2 decreases, resulting in insufficient subcooling degree of the liquefied refrigerant. This deteriorates the condenser performance temporarily. As will be apparent from the above, the orifice-tube system is inferior in response characteristic to load fluctuations, and cannot obtain sufficient refrigeration performance.

It is an object of the present invention to provide a refrigeration system that is excellent in response characteristic to load fluctuations and can obtain sufficient refrigeration performance irrespective of load fluctuations.

It is an object of the present invention to provide a condenser for use in a decompressing-tube system that is excellent in response characteristic to load fluctuations and can obtain sufficient refrigeration performance irrespective of load fluctuations.

Another object of the present invention will be apparent from the following embodiments.

DISCLOSURE OF THE INVENTION

According to the first aspect of the present invention, a refrigeration system having a refrigeration cycle, comprises:

a compressor for compressing a refrigerant;

a condenser for condensing the refrigerant compressed by the compressor;

a decompressing tube for decompressing the refrigerant condensed by the condenser;

an evaporator for evaporating the refrigerant decompressed by the decompressing tube; and an accumulator for separating a gaseous refrigerant from the refrigerant evaporated by the evaporator, wherein the condenser includes a refrigerant inlet for introducing the refrigerant compressed by the compressor, a refrigerant outlet for discharging the refrigerant condensed by the condenser, a refrigerant passage for leading the refrigerant introduced from the refrigerant inlet to the refrigerant outlet while condensing the refrigerant, and decompressing means provided at a part of the refrigerant passage to decompress the refrigerant passing through the decompressing means.

In this refrigeration system, when the thermal load of the condenser decreases, the condensation of refrigerant in the condenser is enhanced at the upstream side of the decompressing means, and therefore only the completely liquefied refrigerant passes through the decompressing means. Thus, the resistance of the refrigerant passing through the decompressing means decreases, thereby increasing the flow rate.

Accordingly, at the upstream side of the decompressing means and the downstream side thereof, the condensation of refrigerant is performed efficiently. Thus, the performance of the condenser is sufficiently demonstrated.

To the contrary, when the thermal load of the condenser increases, the condensation of refrigerant in the condenser deteriorates at the upstream side of the decompressing means, and therefore incompletely liquefied refrigerant passes through the decompressing means. At this time, the amount of gas in the refrigerant increases, i.e., the volume of the refrigerant passing through the decompressing means increases, resulting in increased flow resistance of the refrigerant passing through the decompressing means, which in turn decreases the flow rate. As the flow rate decreases in this way, the condensation load at the upstream side of the decompressing means decreases. Accordingly, the condensation will be performed fully, resulting in enhanced condenser performance.

As will be apparent from the above, since the refrigerant flow rate can be appropriately adjusted in response to fluctuations of thermal load in the condenser, this refrigeration system is excellent in response characteristics to load fluctuations. Accordingly, sufficient refrigeration performance can be obtained.

In this refrigeration system, an orifice-tube can be suitably used as the decompressing tube.

Furthermore, in this refrigeration system, it is preferable that at least a part of the condensed refrigerant is evaporated by the decompressing means and then re-condensed.

That is, in this refrigeration system, it is preferable that at least a part of the refrigerant condensed at an upstream side of the decompressing means in the refrigerant passage is decompressed by the decompressing means into a low-pressure gaseous refrigerant, and the low-pressure gaseous refrigerant is re-condensed at a downstream side of the decompressing means in the refrigerant passage.

According to the second aspect of the present invention, a refrigeration system having a refrigeration cycle in which a refrigerant is compressed into a compressed refrigerant, the compressed refrigerant is condensed into a condensed refrigerant, the condensed refrigerant is decompressed by giving passage resistance into a decompressed refrigerant, the decompressed refrigerant is evaporated into an evaporated refrigerant, and then a gaseous refrigerant is separated from the evaporated refrigerant and re-compressed, wherein a decompressing passage for decompressing the refrigerant is provided at a part of a refrigerant passage in which the compressed refrigerant is condensed.

In this refrigeration system, in the same manner as in the aforementioned system, since the flow rate of the refrigerant is appropriately adjusted by the decompressing passage in response to fluctuations of thermal load, the response characteristics to load fluctuations is excellent, and sufficient refrigeration performance can be obtained.

According to the third aspect of the present invention, as the condenser in the refrigeration system according to the aforementioned first and second aspects of the present invention, the so-called multi-flow type heat exchanger is employed.

That is, a refrigeration system having a refrigeration cycle, comprises:

a compressor for compressing a refrigerant;

a condenser for condensing the refrigerant compressed by the compressor;

a decompressing tube for decompressing the refrigerant condensed by the condenser;

an evaporator for evaporating the refrigerant decompressed by the decompressing tube; and an accumulator for separating a gaseous refrigerant from the refrigerant evaporated by the evaporator, wherein the condenser includes:

a pair of headers disposed in parallel with each other at a certain distance;

a plurality of heat exchanging tubes disposed between the pair of headers with opposite ends thereof connected with the headers;

a partition provided in the header to group the plurality of heat exchanging tubes into a plurality of passes constituting a refrigerant passage through which the refrigerant passes in turn, the plurality of passes including a first pass and a final pass; and decompressing means which is disposed at a part of the refrigerant passage between the first pass and the final pass to decompress the refrigerant passing through the decompressing means.

In this case, in the same manner as in the aforementioned system, the flow rate of refrigerant is appropriately adjusted by the decompressing means in response to fluctuations of thermal load. Thus, the response characteristic is excellent, and sufficient refrigeration performance can be obtained.

In this refrigeration system, an orifice-tube can be suitably used as the decompressing tube.

Furthermore, in this refrigeration system, it is preferable that the plurality of passes include the first pass, the final pass and one or a plurality of intermediate passes located between the first pass and the final pass, and wherein the one or a plurality of intermediate passes constitute a decompressing pass constituting the decompressing means.

In this case, a heat exchanging tube can be used as the decompressing means as it is. Thus, it is not necessary to attach additional components, and therefore the structure can be simplified.

In this refrigeration system, it is preferable that the intermediate pass located immediately before the final pass constitutes the decompressing means, that a total passage cross-sectional area of the decompressing pass is smaller than that of each pass located immediately before and after the decompressing pass, and that the number of heat exchanging tubes constituting the decompressing pass is smaller than that of each pass located immediately before and after the decompressing pass.

In these cases, the decompression effects can be effectively obtained by the decompressing means.

According to the fourth aspect of the present invention, a condenser for use in a decompressing-tube system constituting a refrigeration cycle which includes a compressor, a decompressing tube, an evaporator and an accumulator, comprises:

a refrigerant inlet for introducing a refrigerant;

a refrigerant outlet for discharging the refrigerant;

a refrigerant passage for leading the refrigerant introduced from the refrigerant inlet to the refrigerant outlet while condensing the refrigerant; and decompressing means which is provided at a part of the refrigerant passage to decompress the refrigerant passing through the decompressing means.

In this condenser, in the same manner as in the aforementioned cases, the flow rate of refrigerant is appropriately adjusted by the decompressing means in response to fluctuations of thermal load. Thus, the response characteristic is excellent, and sufficient refrigeration performance can be obtained.

In this condenser, the so-called multi-flow type condenser can be used.

According to the fifth aspect of the present invention, a condenser for use in a decompressing-tube system constituting a refrigeration cycle which includes a compressor, a decompressing tube, an evaporator and an accumulator, comprises:

a pair of headers disposed in parallel with each other at a certain distance;

a plurality of heat exchanging tubes disposed between the pair of headers with opposite ends thereof connected with the headers;

a partition provided in the header to group the plurality of heat exchanging tubes into a plurality of passes constituting a refrigerant passage through which the refrigerant passes in turn, the plurality of passes including a first pass and a final pass; and decompressing means which is disposed at a part of the refrigerant passage between the first pass and the final pass to decompress the refrigerant passing through the decompressing means.

In this condenser, in the same manner as in the aforementioned cases, the response characteristic is excellent, and sufficient refrigeration performance can be obtained.

In this condenser, it is preferable that the plurality of passes include the first pass, the final pass and one or a plurality of intermediate passes located between the first pass and the final pass, and wherein the one or a plurality of intermediate passes constitute a decompressing pass constituting the decompressing means.

In this case, a heat exchanging tube can be used as the decompressing means as it is.

Other objects and the features will be apparent from the following detailed description of the present invention with reference to the attached drawings.

BRIEF DESCRIPTION OF THE DRAWINGS

The present invention will be more fully described and better understood from the following description, taken with the appended drawings, in which.

DETAILED DESCRIPTION OF THE PREFERRED EMBODIMENTS

Figure 1:
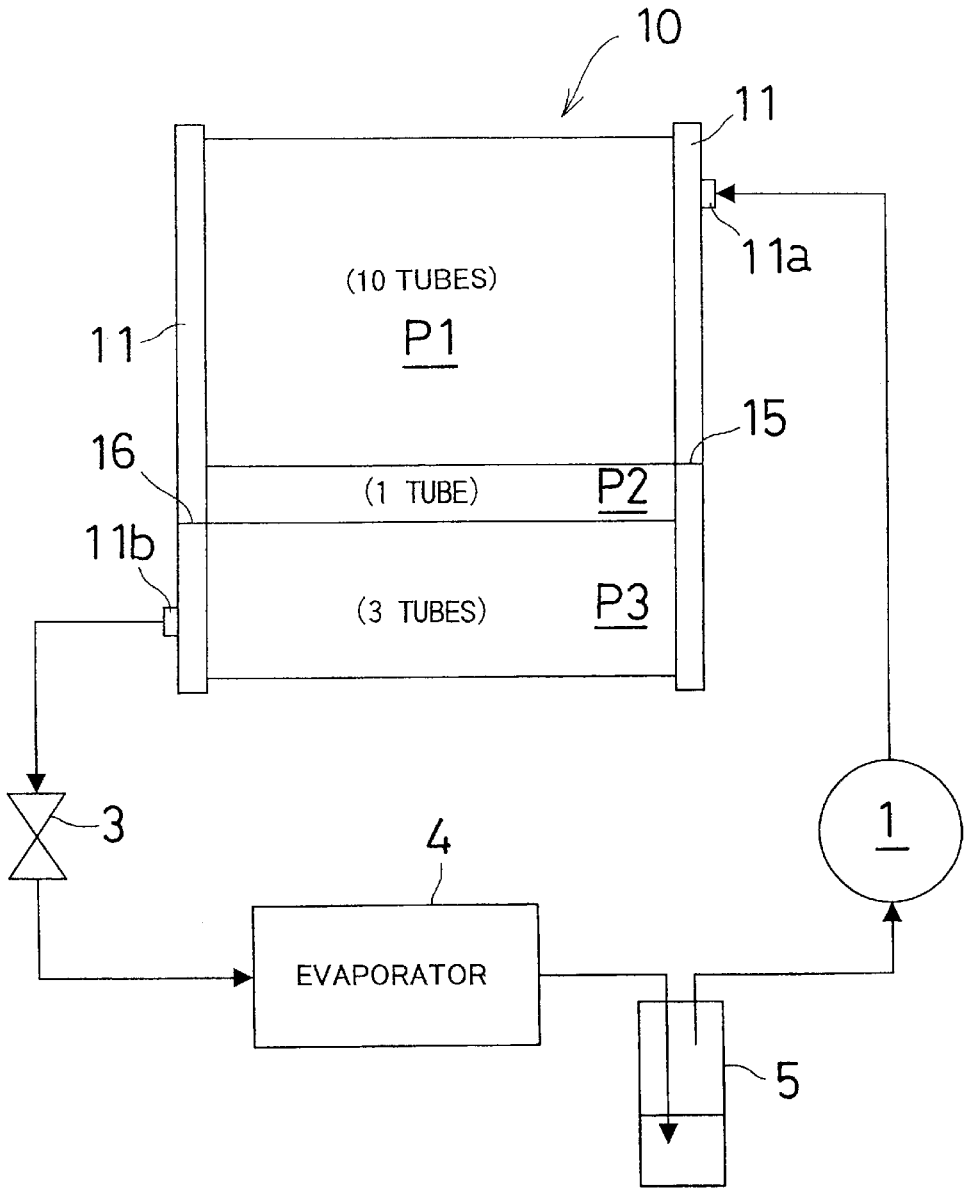
FIG. 1 shows a refrigerant circuit of a refrigeration system according to an embodiment of the present invention.
Figure 2:
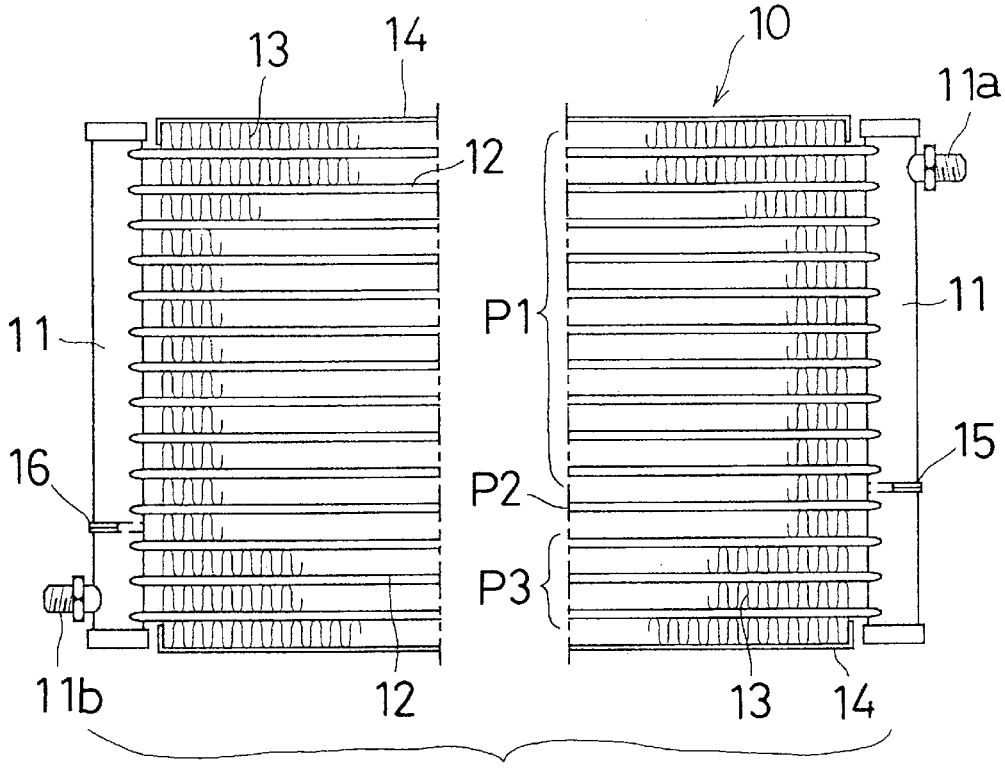
FIG. 2 is a front view showing the condenser employed in the refrigeration system of the embodiment.

FIG. 1 shows a refrigerant circuit of the refrigeration system according to an embodiment of the present invention. FIG. 2 is a front view showing a condenser 10 employed in the refrigeration system.

As shown in these figures, this refrigeration system is an orifice-tube system. In this system, the gaseous refrigerant of high temperature and high pressure sent out from the compressor 1 is introduced into the condenser 10 and condensed therein. The condensed refrigerant is decompressed by the orifice-tube 3 and then introduced into the evaporator 4. In the evaporator 4, the refrigerant exchanges heat with the ambient air to be evaporated. Then, only the gaseous refrigerant is extracted by the accumulator 5 and then returns to the aforementioned compressor 1.

In this refrigeration system, the condenser 10 is the so-called multi-flow type heat exchanger, and is provided with a pair of right and left headers 11 and 11 vertically disposed at a certain distance. Between these headers 11 and 11, a plurality of heat exchanging flat tubes 12 are disposed horizontally in parallel at certain intervals in the direction of up-and-down with the opposite ends thereof connected with the headers 11 and 11. A corrugated fin 13 is disposed between the adjacent heat exchanging tubes 12 and 12. Furthermore, a corrugated fin 13 is arranged on each of the outermost heat exchanging tubes 12. Disposed on the outermost fin 13 is a side plate 14.

Figure 3:
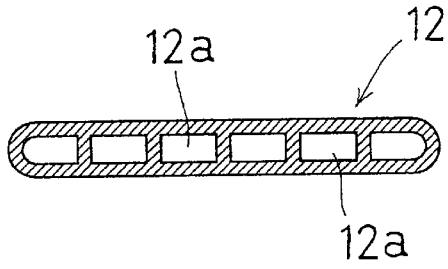
FIG. 3 is a cross-sectional view showing a heat exchanging tube used in the condenser of the embodiment.

As the heat exchanging tube 12, as shown in FIG. 3, the so-called harmonica tube having a plurality of refrigerant passages 12*a* arranged side by side inside is generally used.

Figure 4:
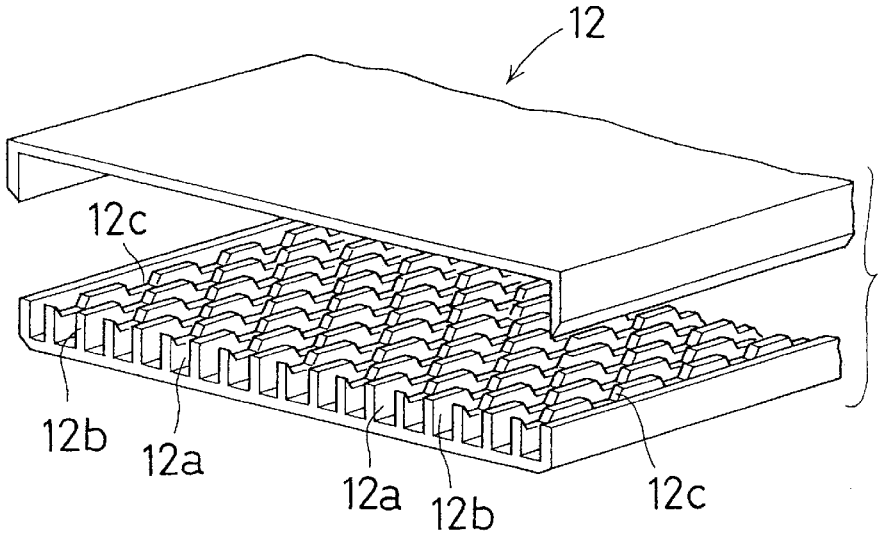
FIG. 4 is an exploded perspective view showing a heat exchanging tube for condensers according to a first modification of the present invention.
Figure 5A:
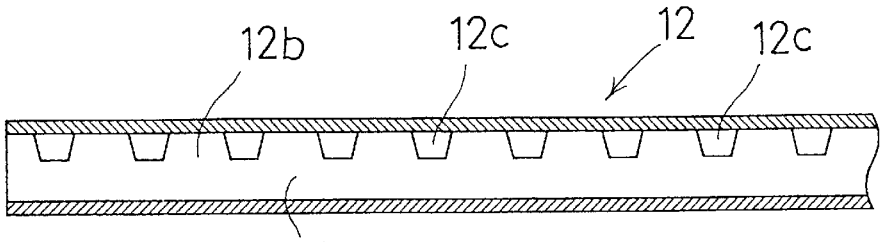
FIG. 5A is a side cross-sectional view showing the heat exchanging tube of the first modification.
Figure 5B:
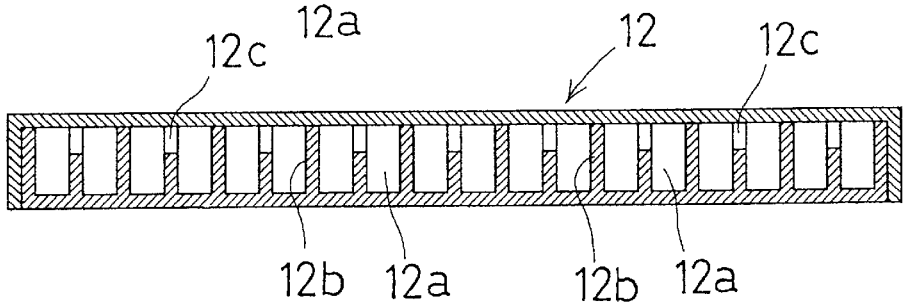
FIG. 5B is the front cross-sectional view showing the heat exchanging tube of the first modification.
Figure 6:
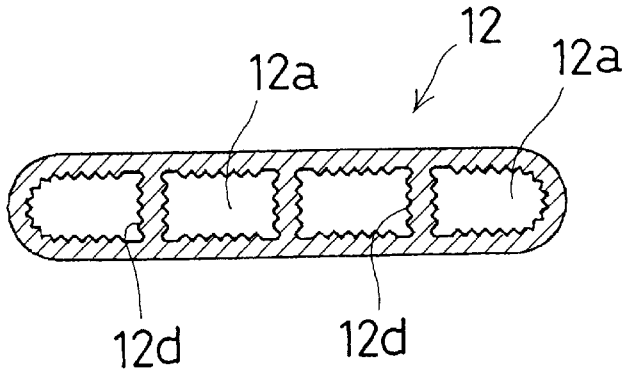
FIG. 6 is a cross-sectional view showing a heat exchanging tube for condensers according to a second modification of the present invention.

In the present invention, in place of the aforementioned heat exchanging tube, the heat exchanging tube as shown in FIGS. 4 and 5 can also be preferably used. This heat exchanging tube 12 is provided with a plurality of refrigerant passages 12*a*. The adjacent refrigerant passages 12*a* and 12*a* are communicated with each other via a plurality of communication apertures 12*c* formed in the partition wall 12*b* which partitions the adjacent passages 12*a* and 12*a*. Furthermore, the heat exchanging tube 12 with numerous inner fins 12*d* as shown in FIG. 6 can also be suitably used. In this heat exchanging tube 12, a plurality of inner fins 12*d* are protruded from the inner surface of each refrigerant passage 12*a*.

As shown in FIGS. 1 and 2, partitions 15 and 16 for dividing the inside of the header 11 are provided at the predetermined positions of the headers 11 and 11. In this embodiment, the $1^{st}$ to $10^{th}$ heat exchanging tubes counted from the uppermost tube constitute the first pass P1. The $11^{th}$ heat exchanging tube 12 counted from the uppermost tube constitutes the second pass P2. The $12^{th}$ to $14^{th}$ heat exchanging tubes 12 counted from the uppermost tube constitute the third pass P3 which is the final pass.

In this embodiment, the first pass P1 constitutes a first condensing portion. The second pass P2 constitutes a decompressing pass (a decompressing means, a decompressing passage), and the third pass P3 constitutes a second condensing portion (re-condensing portion).

Furthermore, a refrigerant inlet 11*a* is provided at the upper portion of one of the headers 11 (right-hand side header), and a refrigerant outlet 11*b* is provided at the lower portion of the other header 11 (left-hand side header). The refrigerant introduced into the header 11 via the refrigerant inlet 11*a* passes through the first pass to the third pass in a meandering manner in turn, and then flows out of the refrigerant outlet 11*b*.

As shown in FIG. 1, this condenser 10 is connected with the compressor 1, the orifice-tube 3, the evaporator 4 and the accumulator 5 via refrigerant tubes to form a refrigeration system for automobiles.

Figure 7:
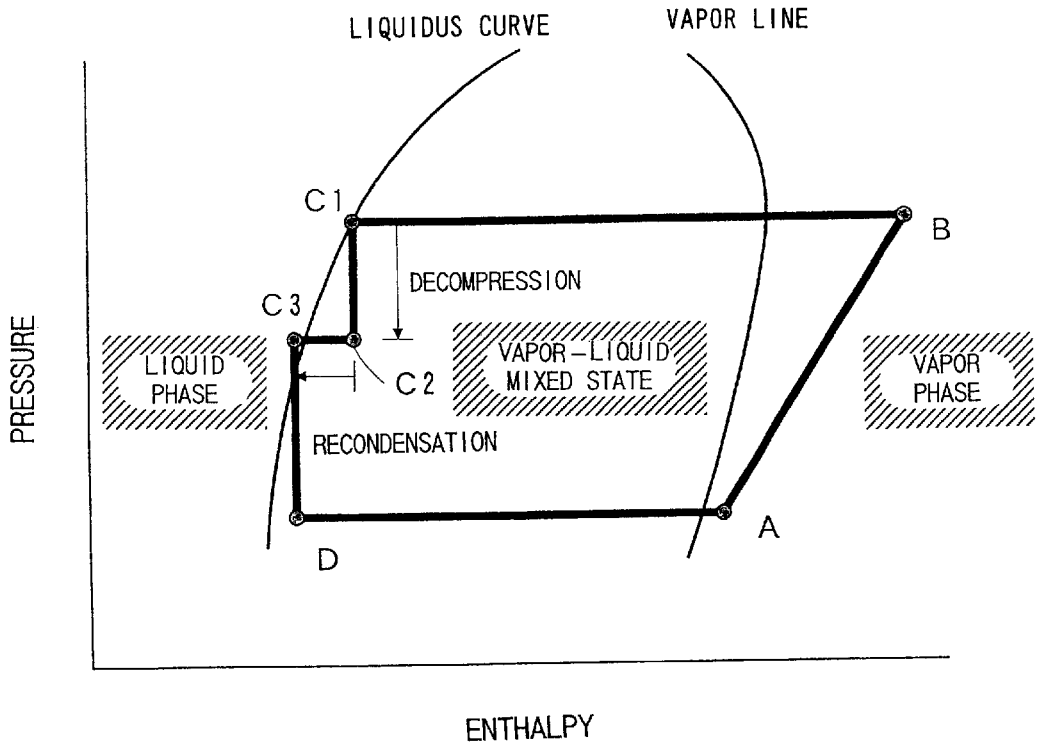
FIG. 7 is a Mollier diagram of the refrigeration cycle in the refrigeration system according to the present invention.
Figure 8:
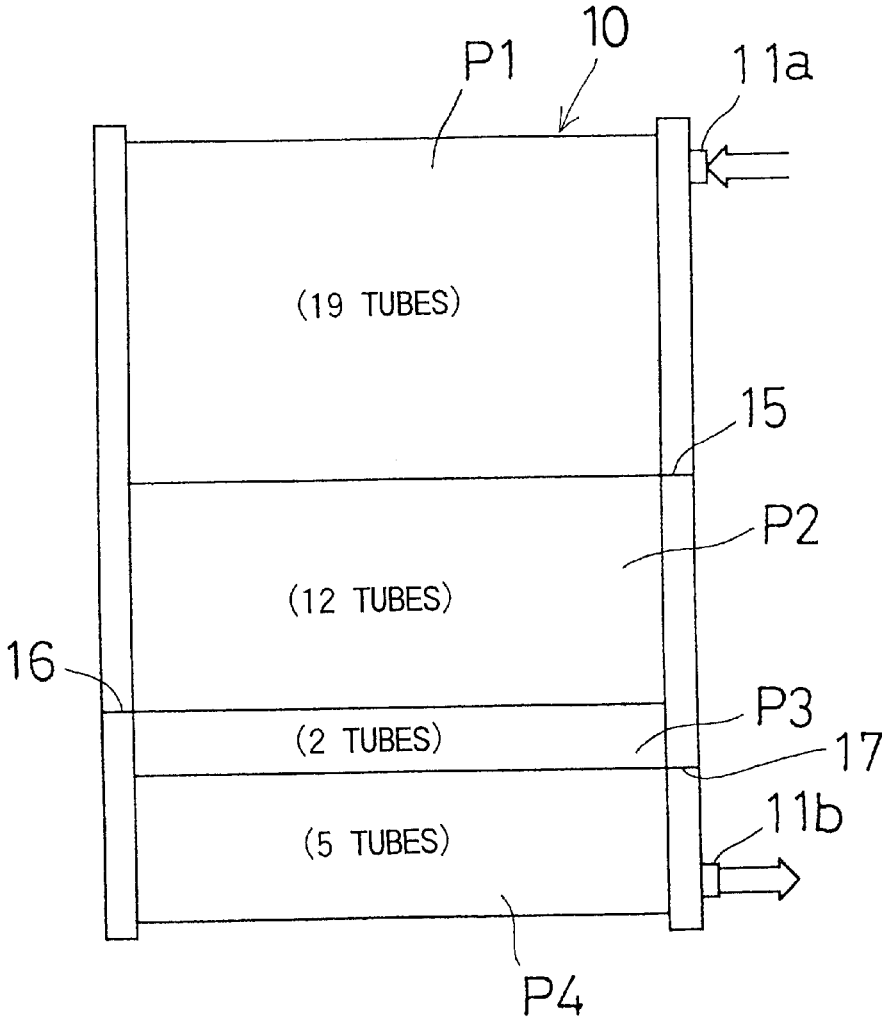
FIG. 8 shows a refrigerant circuit of a refrigeration system according to a third embodiment of the present invention.

Next, the operation of the refrigeration system of this embodiment will be explained with reference to the Mollier diagram shown in FIG. 7.

In this diagram, the refrigerant at the region on the left side of the liquidus curve is in a liquid phase state. The refrigerant at the region between the liquidus curve and the vapor line is in a vapor-liquid mixed phase state. The refrigerant at the region on the right side of the vapor line is in a vapor phase.

In this refrigeration system, the refrigerant compressed by the compressor 1 shifts from the point A to the point B to become a gaseous refrigerant of high temperature and high pressure. The gaseous refrigerant is then introduced into the condenser 10. In the condenser 10, the refrigerant passed through the first pass P1 is condensed, and shifts from the point B to the point C1. Subsequently, the liquefied refrigerant passes through the decompressing pass P2 to be decompressed, and shifts from the point C1 to the point C2. Thereafter, the refrigerant passes through the third pass P3 to be re-condensed, and shifts from the point C2 to the point C3.

The condensed refrigerant passes through the orifice-tube 3 to be decompressed, and shifts from the point C3 to the point D in which the refrigerant is in a vapor-liquid mixed phase state. Then, the refrigerant is sent to the evaporator 4, and exchanges heat with the ambient air therein to be evaporated. Thus, the refrigerant shifts from the point D to the point A, and then returns to the aforementioned compressor 1.

In this refrigeration system, when the thermal load of the condenser increases suddenly, the condensation of refrigerant in the first pass P1 deteriorates, and therefore incompletely liquefied refrigerant is introduced into the decompressing pass P2. At this time, the amount of gas in the refrigerant increases, i.e., the volume of the refrigerant passing through the decompressing pass P2 increases, resulting in increased flow resistance of the refrigerant passing through the decompressing pass P2, which in turn increases the flow resistance of the refrigerant to thereby decrease the flow rate. As the flow rate decreases in the decompressing pass P2, the condensation load at the upstream side of the decompressing means pass P2, i.e., the condensation load at the first pass P1 decreases. Accordingly, the condensation and decompression will be performed smoothly in each pass P1 to P3, resulting in enhanced condenser performance.

To the contrary, in this refrigeration system, when the thermal load of the condenser decreases suddenly, the condensation of refrigerant in the first pass P1 is performed fully, and therefore only the completely liquefied refrigerant is introduced into the decompressing pass P2. Thus, the resistance of the refrigerant passing through the decompressing pass P2 decreases, thereby increasing the flow rate. Accordingly, at the upstream side of the decompressing pass P2, i.e., at the fist pass P1, the condensation of refrigerant is performed efficiently. Thus, the refrigerant is effectively condensed or decompressed in each pass P1 to P3. Therefore, the performance of the condenser is sufficiently demonstrated.

Thus, in the refrigeration system of this embodiment, since the decompressing pass P2 has a self-control function for controlling the refrigerant flow rate in response to fluctuations of thermal load. Accordingly, the circulation flow rate of refrigerant in the refrigeration cycle can be adjusted appropriately. Therefore, the response characteristic to load fluctuations is excellent, and thus sufficient refrigeration performance can be obtained.

Furthermore, in the refrigeration system of this embodiment, the refrigerant is initially condensed in the first pass P1 of the condenser to release the heat, and then secondarily condensed in the second pass P2 to release the heat. Therefore, sufficient heat release can be secured, which in turn can secure a large enthalpy difference (D−A) at the time of evaporation. Thus, outstanding refrigeration effects can be obtained.

Furthermore, in this condenser, since the amount of releasing heat is increased by the secondary condensation accompanying phase changes, the heat can be effectively released. In other words, in the condenser 10 of this embodiment, since almost the entire region thereof constitutes a condensing portion, the heat radiation of the refrigerant can be effectively performed, resulting in excellent condensing performance. Accordingly, the refrigerant can be condensed assuredly while preventing the rise of the refrigerant pressure within the refrigeration cycle. Thus, the load of the compressor 1 can be decreased. Accordingly, it becomes possible to prevent the enlargement of the compressor 1, resulting in a small and lightweight refrigeration system, an enhanced fuel consumption rate at the time of mounting the system on an automobile, a reduced amount of refrigerant and a decreased cost.

In the aforementioned embodiment, the number of passes and the number of tubes constituting each pass, especially the number of tubes constituting the decompressing pass, are not limited to the above. For example, it is possible that four passes P1 to P4 are provided and the number of the third pass P3 constitutes the decompressing pass including two tubes.

Figure 9:
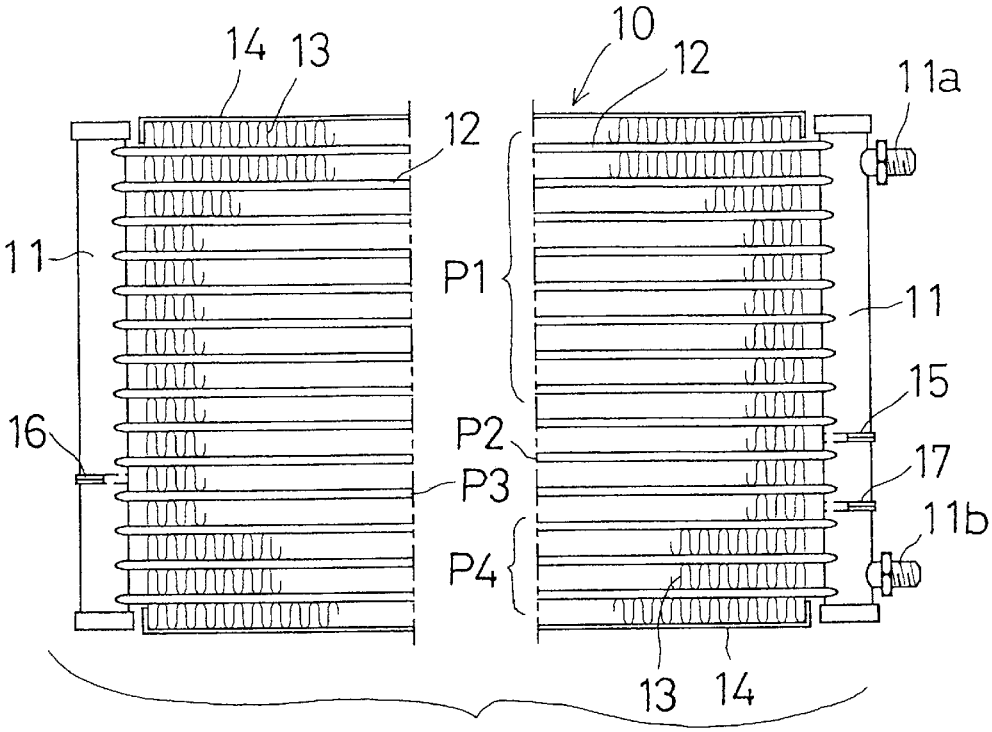
FIG. 9 is a front view showing a condenser according to a fourth embodiment of the present invention.
Figure 10:
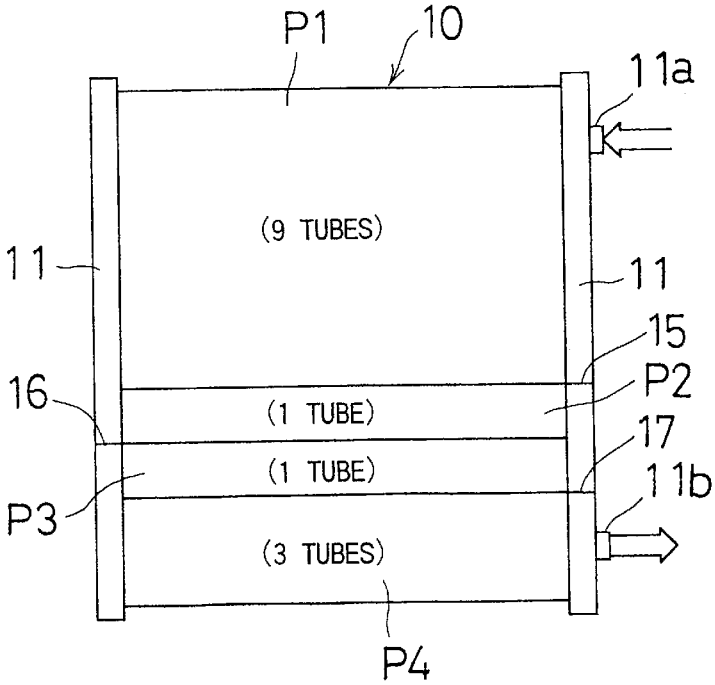
FIG. 10 shows a refrigerant circuit of a refrigeration system according to the fourth embodiment of the present invention.

Furthermore, in this invention, two or more decompressing passes may be provided. For example, as shown in FIGS. 9 and 10, the headers 11 and 11 may be partitioned by partitions 15 to 17 to form four passes P1 to P4, and the second pass P2 and the third pass P3, each including one tube 12, may constitute a decompressing pass, respectively.

Figure 11:
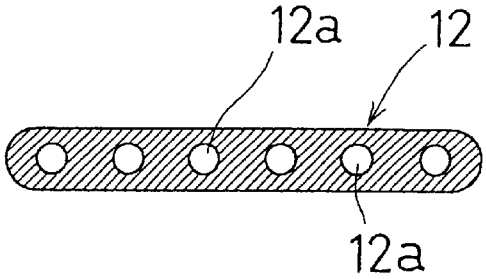
FIG. 11 is a cross-sectional view showing a heat exchanging tube for a decompression pass according to a fourth modification of the present invention.

Furthermore, in the present invention, in order to enhance the decompression effects, a tube constituting a decompressing pass may be constituted by a tube different from the other tube in structure. For example, as shown in FIG. 11, the so-called harmonica tube having a plurality of refrigerant small circular passages 12*a* may be used as a heat exchanging tube for a decompressing pass.

Furthermore, as a tube constituting a decompressing pass, it is not necessary to use a straight tube. For example, it may be possible to employ a serpentine type tube bent in a zigzag manner for a serpentine type heat exchanger or a capillary tube.

Furthermore, it is not necessary to constitute the decompressing means by a heat exchanging tube. For example, it is possible to provide a decompressing means such as a partitioning plate with an orifice formed in a tube.

Furthermore, in the present invention, it is not necessary to provide a decompressing means in a heat exchanging tube, and a decompressing means may be provided in a header. In short, it is enough that decompressing means or a decompressing passage is provided at a part of a refrigerant passage between a refrigerant inlet and a refrigerant outlet.

EXAMPLE

The so-called multi-flow type condenser having four passes, the first pass to the fourth four pass, was prepared. The first pass was constituted by 19 heat exchanging tubes, the second pass was constituted by 8 heat exchanging tubes, the third pass (decompressing pass) was constituted by 1 heat exchanging tube, and the fourth pass was constituted by 7 heat exchanging tubes.

In the refrigeration cycle including the condenser as shown in FIG. 1, the cooling performance (kW), the compressor discharge pressure (kPa) and the coefficient of performance to the compressor rotation speed (rpm) were measured.

COMPARATIVE EXAMPLE

The so-called multi-flow type condenser having a first pass constituted by 14 heat exchanging tubes, a second pass constituted by 10 tubes, a third pass constituted by 7 tubes and a fourth pass constituted by 4 tubes was prepared. By using the condenser, the same examination as in the aforementioned example was performed.

Figure 12:
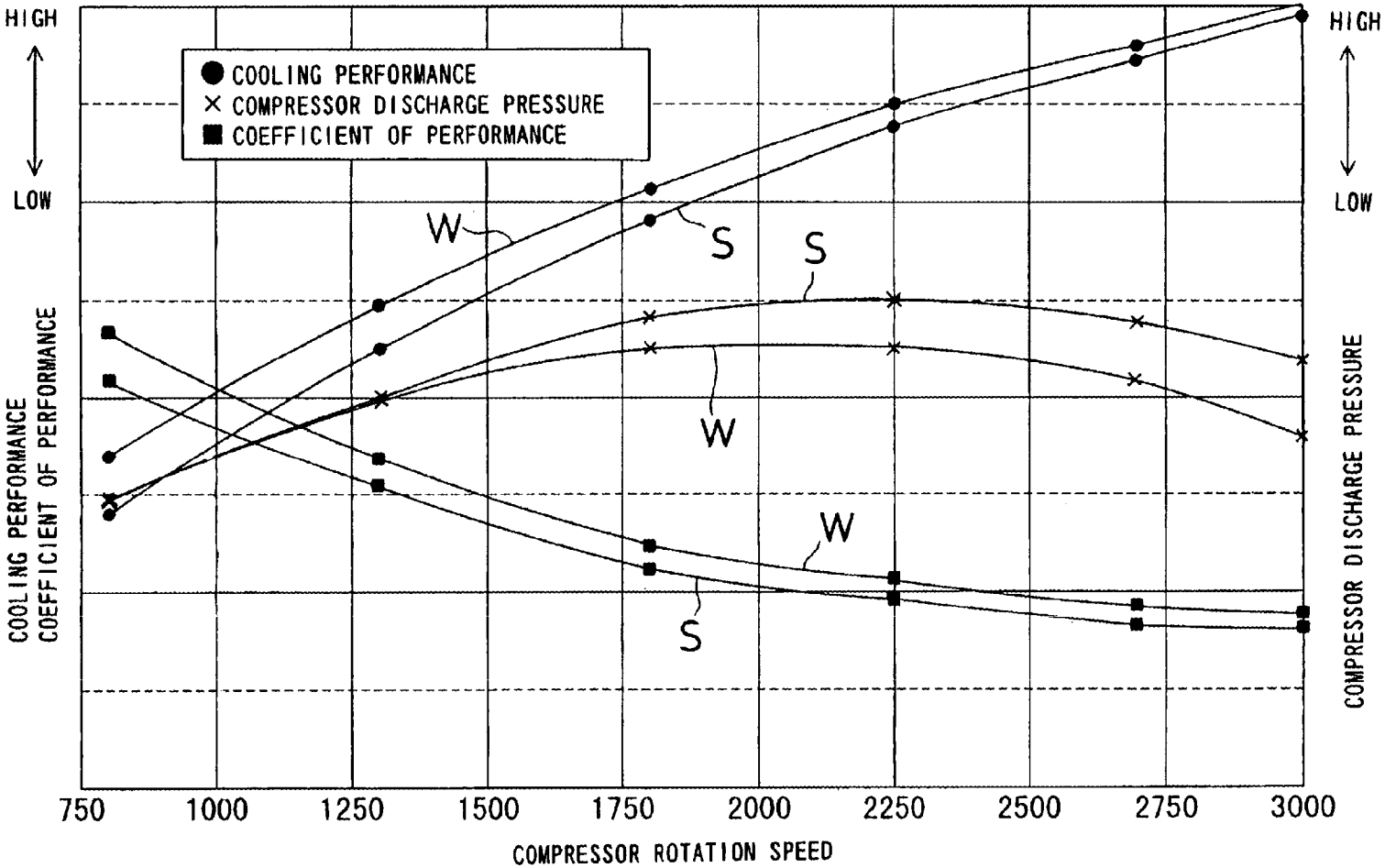
FIG. 12 is a graph showing the relation of the cooling performance, the compressor discharge pressure and the coefficient of performance relative to the compressor rotating speed in the refrigeration system.
Figure 13:
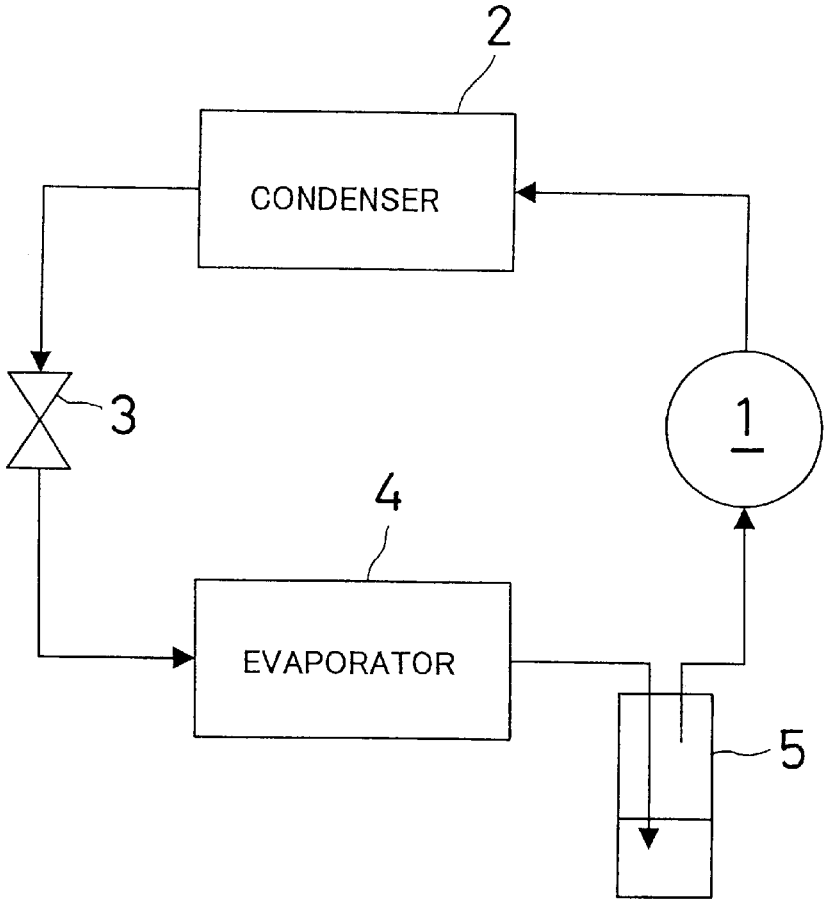
FIG. 13 shows a refrigerant circuit of a conventional orifice-tube system.

The measured results of the aforementioned example and comparative example are shown in the graph shown in FIG. 12. In the graph, "W" denotes the example, and "S"0 denotes the comparative example. Furthermore, the round mark denotes the cooling performance, the square mark denotes a coefficient of performance and "x" mark denotes the compressor discharge pressure.

As will apparent from the graph, it is understood that, in each of the cooling performance, the compressor discharge pressure and the coefficient of performance, the refrigeration cycle of the example is superior to that of the comparative example.

As mentioned above, according to the present invention, in a decompressing-tube system such as an orifice-tube system, since the flow rate of refrigerant is appropriately adjusted by the decompressing means or the decompressing passage in response to fluctuations of thermal load in the condensing portion, the response characteristics to load fluctuations is excellent, and sufficient refrigeration performance can be obtained.

This application claims priority to Japanese Patent Application No. 2001-278975 filed on Sep. 14, 2001, the disclosure of which is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed

What is claimed is:

1. A refrigeration system having a refrigeration cycle, said refrigeration system comprising:

a compressor for compressing a refrigerant;

a condenser for condensing the refrigerant compressed by said compressor;

a decompressing tube for decompressing the refrigerant condensed by said condenser;

an evaporator for evaporating the refrigerant decompressed by said decompressing tube; and an accumulator for separating a gaseous refrigerant from the refrigerant evaporated by said evaporator, wherein said condenser includes a refrigerant inlet for introducing the refrigerant compressed by said compressor, a refrigerant outlet for discharging the refrigerant condensed by said condenser, a refrigerant passage for leading the refrigerant introduced from said refrigerant inlet to said refrigerant outlet while condensing the refrigerant, and decompressing means provided at a part of said refrigerant passage to decompress the refrigerant passing through said decompressing means.

2. The refrigeration system as recited in claim 1, wherein said decompressing tube is an orifice-tube.

3. The refrigeration system as recited in claim 1, at least a part of the refrigerant condensed at an upstream side of said decompressing means in said refrigerant passage is decompressed by said decompressing means into a low-pressure gaseous refrigerant, and the low-pressure gaseous refrigerant is recondensed at a downstream side of said decompressing means in said refrigerant passage.

4. The refrigeration system as recited in claim 2, at least a part of the refrigerant condensed at an upstream side of said decompressing means in said refrigerant passage is decompressed by said decompressing means into a low-pressure gaseous refrigerant, and the low-pressure gaseous refrigerant is recondensed at a downstream side of said decompressing means in said refrigerant passage.

5. A refrigeration system having a refrigeration cycle in which a refrigerant is compressed into a compressed refrigerant, the compressed refrigerant is condensed into a condensed refrigerant, the condensed refrigerant is decompressed by giving passage resistance into a decompressed refrigerant, the decompressed refrigerant is evaporated into an evaporated refrigerant, and then a gaseous refrigerant is separated from the evaporated refrigerant and re-compressed, wherein a decompressing passage for decompressing the refrigerant is provided at a part of a refrigerant passage in which the compressed refrigerant is condensed.

6. A refrigeration system having a refrigeration cycle, said refrigeration system comprising:

a compressor for compressing a refrigerant;

a condenser for condensing the refrigerant compressed by said compressor;

a decompressing tube for decompressing the refrigerant condensed by said condenser;

an evaporator for evaporating the refrigerant decompressed by said decompressing tube; and an accumulator for separating a gaseous refrigerant from the refrigerant evaporated by said evaporator, wherein said condenser includes:

a pair of headers disposed in parallel with each other at a certain distance;

a plurality of heat exchanging tubes disposed between said pair of headers with opposite ends thereof connected with said headers;

a partition provided in said header to group said plurality of heat exchanging tubes into a plurality of passes constituting a refrigerant passage through which the refrigerant passes in turn, said plurality of passes including a first pass and a final pass; and decompressing means which is disposed at a part of said refrigerant passage between said first pass and said final pass to decompress the refrigerant passing through said decompressing means.

7. The refrigeration system as recited in claim 6, wherein said decompressing tube is an orifice-tube.

8. The refrigeration system as recited in claim 7, wherein said plurality of passes include said first pass, said final pass and one or a plurality of intermediate passes located between said first pass and said final pass, and wherein said one or a plurality of intermediate passes constitute a decompressing pass constituting said decompressing means.

9. The refrigeration system as recited in claim 8, wherein said intermediate pass located immediately before said final pass constitutes said decompressing means.

10. The refrigeration system as recited in claim 9, wherein a total passage cross-sectional area of said decompressing pass is smaller than that of each pass located immediately before and after said decompressing pass.

11. The refrigeration system as recited in claim 9, wherein the number of heat exchanging tubes constituting said decompressing pass is smaller than that of each pass located immediately before and after said decompressing pass.

12. The refrigeration system as recited in claim 8, wherein a total passage cross-sectional area of said decompressing pass is smaller than that of each pass located immediately before and after said decompressing pass.

13. The refrigeration system as recited in claim 8, wherein the number of heat exchanging tubes constituting said decompressing pass is smaller than that of each pass located immediately before and after said decompressing pass.

14. The refrigeration system as recited in claim 6, wherein said plurality of passes include said first pass, said final pass and one or a plurality of intermediate passes located between said first pass and said final pass, and wherein said one or a plurality of intermediate passes constitute a decompressing pass constituting said decompressing means.

15. The refrigeration system as recited in claim 14, wherein the number of heat exchanging tubes constituting said decompressing pass is smaller than that of each pass located immediately before and after said decompressing pass.

16. A condenser for use in a decompressing-tube system constituting a refrigeration cycle which includes a compressor, a decompressing tube, an evaporator and an accumulator, said condenser comprising:

a refrigerant inlet for introducing a refrigerant;

a refrigerant outlet for discharging the refrigerant;

a refrigerant passage for leading the refrigerant introduced from said refrigerant inlet to said refrigerant outlet while condensing the refrigerant; and decompressing means which is provided at a part of said refrigerant passage to decompress the refrigerant passing through said decompressing means.

17. A condenser for use in a decompressing-tube system constituting a refrigeration cycle which includes a compressor, a decompressing tube, an evaporator and an accumulator, said condenser comprising:

a pair of headers disposed in parallel with each other at a certain distance;

a plurality of heat exchanging tubes disposed between said pair of headers with opposite ends thereof connected with said headers;

a partition provided in said header to group said plurality of heat exchanging tubes into a plurality of passes constituting a refrigerant passage through which the refrigerant passes in turn, said plurality of passes including a first pass and a final pass; and decompressing means which is disposed at a part of said refrigerant passage between said first pass and said final pass to decompress the refrigerant passing through said decompressing means.

18. The refrigeration system as recited in claim 17, wherein said plurality of passes include said first pass, said final pass and one or a plurality of intermediate passes located between said first pass and said final pass, and wherein said one or a plurality of intermediate passes constitute a decompressing pass constituting said decompressing means.

* * * * *